United States Patent [19]

Eckel

[11] 4,038,796

[45] Aug. 2, 1977

[54] WALL PANEL ASSEMBLY

[75] Inventor: Alan Eckel, Westford, Mass.

[73] Assignee: Eckel Industries, Inc., Cambridge, Mass.

[21] Appl. No.: 643,698

[22] Filed: Dec. 23, 1975

[51] Int. Cl.[2] ..... E04F 17/00

[52] U.S. Cl. ..... 52/221; 52/262; 52/300; 52/584

[58] Field of Search ..... 52/220, 221, 262, 274, 52/404, 464, 584, 238, 266, 463, 300, 271, 272

[56] References Cited

U.S. PATENT DOCUMENTS

| | | | |
|---|---|---|---|
| 2,616,529 | 11/1952 | MacDonald | 52/404 |
| 2,696,279 | 12/1954 | Schofield | 52/404 |
| 2,822,898 | 2/1958 | Richards | 52/464 |
| 2,836,266 | 5/1958 | Leeser | 52/404 |
| 2,876,275 | 3/1959 | Schulz | 52/272 X |
| 3,332,190 | 7/1967 | Ekstrom | 52/464 |
| 3,363,383 | 1/1968 | LaBarge | 52/584 |
| 3,745,733 | 7/1973 | Litvin et al. | 52/262 |
| 3,921,354 | 11/1975 | Connelly et al. | 52/274 |

FOREIGN PATENT DOCUMENTS

| | | | |
|---|---|---|---|
| 2,349,125 | 4/1974 | Germany | 114/78 |

*Primary Examiner*—J. Karl Bell
*Attorney, Agent, or Firm*—Schiller & Pandiscio

[57] ABSTRACT

A novel acoustical wall assembly comprises at least two modular sound absorbing panels. Each panel includes a substantially flat body and an integral tongue extending substantially parallel to and spaced from one edge of the body so as to form a channel therebetween. A double channel connector, comprising first and second U-shaped channel members, is utilized to connect the panels together in a coplanar relation. The side plates of the first channel member fit into the channels of the confronting edges of two modularly aligned panels, and the side plates of the second channel member fit between the panels in tight fitting relationship with the tongues. An L-shaped connector having two side flanges is used to connect the panels together to form a corner wherein the side flanges of the connector fit into the channels of the confronting edges of two adjacent panels. A floor channel member is provided to (a) reinforce the lower longitudinal edges of the panels and (b) secure the panels to the floor, while a ceiling cap is provided to (a) reinforce the upper longitudinal edges of the panels and (b) support ceiling panels.

19 Claims, 4 Drawing Figures

WALL PANEL ASSEMBLY

This invention relates to panel assemblies and more particularly to panel assemblies of the modular type.

Modular acoustical panel assemblies are well known for providing sound absorbing and attenuating walls and ceilings which are easy to construct and build with minimum effort and skill. One commercially available acoustical panel assembly, which is described and claimed in my U.s. Pat. No. 3,608,260, includes a plurality of substantially flat panels, which are aligned with one another in a substantially coplanar relationship. The two side confronting edges of any two adjacent aligned panels are each provided with a "tongue" or "joiner" which extends parallel to and is spaced from the main body of the panel so as to form a space therebetween. The space is open along one side of the panel and the panels are alternately oriented so that the tongue of each panel extends into the space provided between the tongue and main body of the adjacent panel to provide an interlocking joint. Gaskets are provided in the tongue-receiving spaces of each panel to insure a tight fitting joint when the two panels are joined together. It has been found that this assembly does not provide relatively good acoustical insulation; nor is the assembly as structurally as sound as may be desired. Another problem with my prior design is that various modifications must be made to the assembly in order to run water lines, electrical cable and the like, along and through the wall formed by the assembly. Further if one side of each wall panel is perforated or otherwise made differently from its other side, on assembly every other panel will be reversed unless two types of panels are made (which would reduce or eliminate certain advantages of the modular nature of the assembly). The resulting wall construction may not only be aesthetically displeasing but also the reversal of the panels may affect the acoustical insulating or absorbing properties of the paneled wall.

Therefore, the primary object of the present invention is to overcome certain limitations of my prior acoustical panel assembly.

More specifically, objects of the present invention are to provide a modular wall panel assembly having relatively improved acoustical insulation and structural characteristics, to provide an acoustical modular panel assembly having means for accommodating plumbing lines, electrical cable or the like; to provide a sound-absorbing and attenuating modular panel assembly which is designed so as to easily accommodate a door and door frame; to provide an acoustical assembly in which each panel may be manufactured identically to one another and easily assembled together to form walls and ceilings; and to provide an assembly in which ceiling panels can be easily supported to like or similar side wall panels.

These and other objects are achieved by a modular wall assembly which comprises at least two panel modules which are capable of being aligned and oriented with respect to one another, so that two side edges of the respective panels are in confronting and spaced relationship. Each panel includes a substantially flat body and at least one tongue which extends along a side edge of the panel substantially parallel to and spaced from the body so as to form a channel therebetween which is open along one side of the panel. The panel assembly also includes connector means for connecting the panels together in an acoustically tight fashion. In order to connect the panels together in a coplanar relation, the connector means includes two preferably U-shaped connector members which are utilized to join together the two confronting side edges of two adjacent panels. Each connector member comprises two parallel side plates and a web or strap connected to and supporting the side plates. Each side plate of one connector member extends within a corresponding one of the channels of each panel where it makes a tight fit with the adjacent tongue and flat body. The other connector member is fitted between the two panels so its side plates extend in between and make a tight fit with the adjacent tongues of the two adjoining panels. Where the two adjacent panels are to be connected so as to form a corner, the connector means comprises an L-shaped connector member, with each of its two side flanges extending within the channels of one of the adjacent panels and making a tight fit with the adjacent tongue and flat body of that panel. Means are also provided for reinforcing the upper and lower longitudinal edges of the panels, for securing the assembly to the floor and for mounting ceiling panels to the panel wall assembly thus formed.

Other features and many of the attendant advantages of the invention are disclosed in or rendered obvious by the following detailed description which is to be considered together with the accompanying drawings in which.

Figure 1:
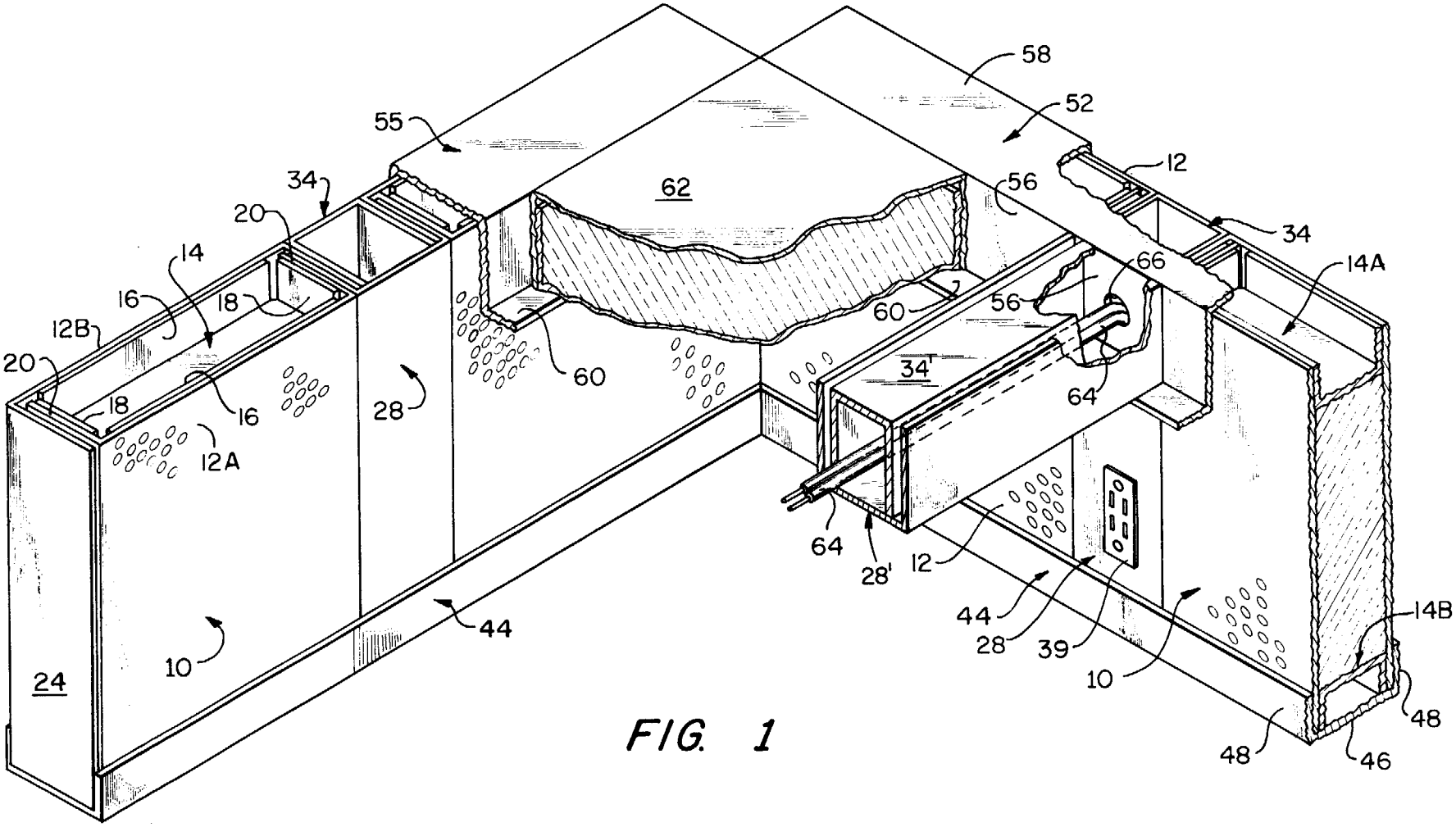
FIG. 1 shows a fragmented perspective view of a preferred embodiment of the present invention.

In the drawings like numerals refer to like parts. Also, for convenience of illustration, the thickness of the panels is exaggerated in the drawings. In practice, for example, the panels may measure 41 feet wide, 8 feet high, and 2 inches thick.

The illustrated assembly comprises at least two sound absorbing panels 10, each including a pair of flat plates 12A and 12B mounted in a parallel and spaced relationship with respect to each other so as to form a substantially flat body.

While both of the plates may be perforated (so as to render it transparent to sound) or solid, in the preferred embodiment plate 12A is perforated and plate 12B is not perforated.

Figure 2:
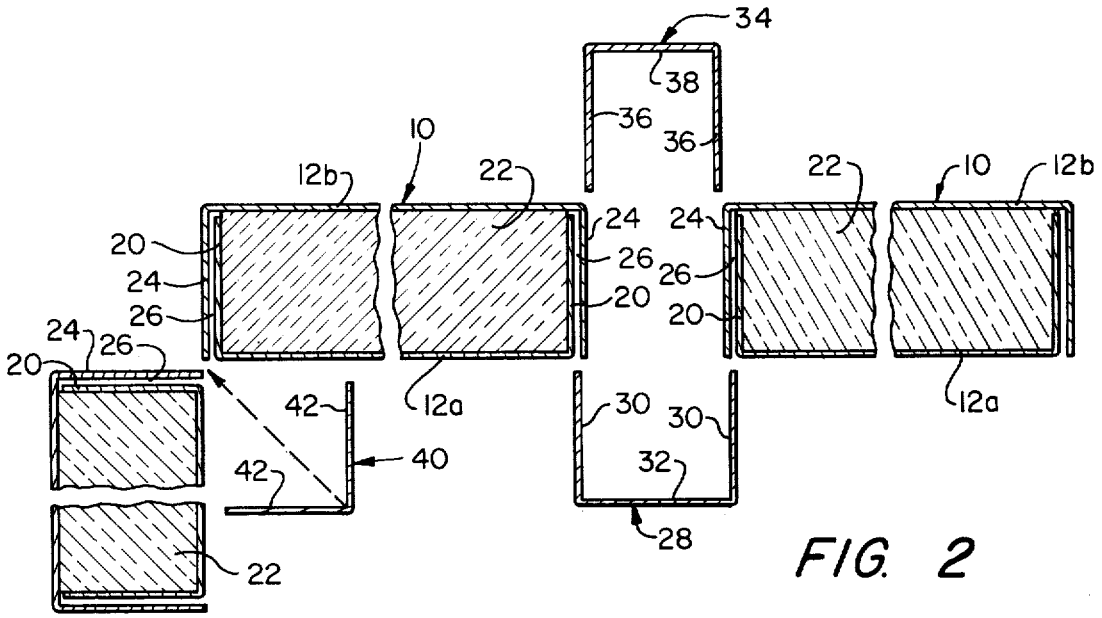
FIG. 2 shows a fragmented plan sectional view, partially exploded, of the embodiment of FIG. 1.

Both the top and bottom longitudinal edges of the two plates of each panel are secured together by stiffeners 14A and 14B. Each stiffener has a pair of side flanges 16 which are secured to the inside surfaces of plates 12A and 12B and end flange 18 which extend transversely to and spaced from the side flanges so as to provide a relief at each corner of the stiffener. Each plate 12A is provided with right angle side extensions 20 which are secured to the end flanges 18 of stiffeners 14A and 14B and serve as the side edges of the panel so as to enclose the space between plates 12A and 12B which is filled with a suitable sound absorbing material 22 such as glass fibers or a plastic foam. The other plate 12B is preferably formed with right angle side extensions 24, hereinafter referred to as "tongues 24." Each tongue extends along the entire side edge of the panel and is spaced from the side extensions 20 so as to form a channel 26 therebetween (see FIG. 2) which is open along the perforated plate side of the panel.

Figure 3:
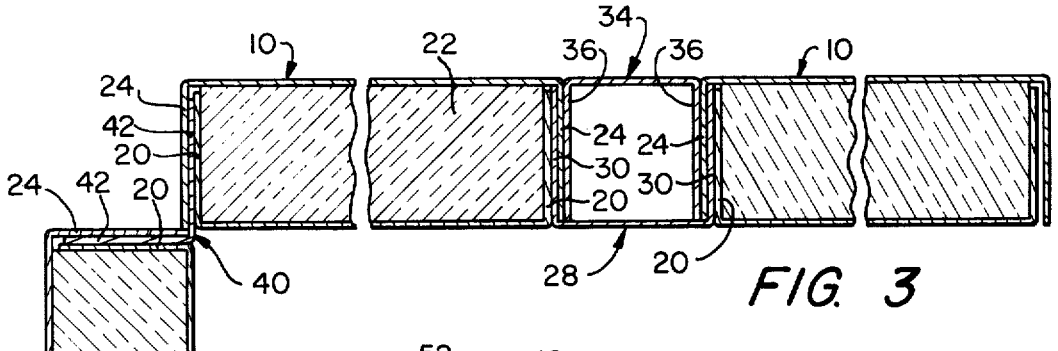
FIG. 3 shows a fragmented plan sectional view of the assembly of FIG. 1 assembled for use.

In order to connect two panels 10 together in a substantially coplanar relationship, connecting means in the form of a double channel connector is employed. Specifically, each double channel connector includes outer and inner U-shaped channel members 28 and 34, respectively. Channel member 28 has two parallel spaced side plates 30 and a strap or web portion 32 connected to and supporting the side plates at a right angle thereto. Channel members 28 preferably extend the full height of the panels. The two panels to be connected are spaced from one another so that the side plates 30 of the channel member 28 extend into corresponding ones of the channels 26 at the confronting side edges of the two panels. Each side plate 30 makes a snug, preferably tight, fit with the tongue 24 and extension 20 of a panel and when the side plates 30 are properly positioned in the channels, the web portion 32 of member 28 is preferably flush with the outer surfaces of the plates 12A of the two panels. The inner channel 34 coacts with the outer channel member 28 so as to make a substantially rigid joint between the two panels and also to provide greater structural support for the panels. The inner channel member 34 has parallel spaced apart side plates 36 and a strap or web portion 38 connected to and supporting the side plates at a right angle thereto. The inner channel member also preferably extends for the full height of the panels. The inner channel member 34 makes a snug, preferably tight, fit between the two panels when the panels are coupled together by the outer channel member 28 as described and shown. Specifically, the side plates 36 of each channel member 34 extend between and make a snug, preferably tight, fit with the exterior surfaces of the tongues 24 of the two adjacent panels. The side plates 36 are dimensioned so that when the inner channel member 34 is properly in position between the panels, the web portion 38 is substantially flush with the plates 12B of the two adjacent panels, as shown in FIG. 3.

The double channel connector formed by the outer and inner channel members 28 and 34 not only provides a rigid vertical post or column for structurally supporting two adjacent modular panels in a coplanar relationship, but also forms a hollow column which can easily function as a raceway for electrical cables, piping and the like. Thus, for example, the web portion 32 of member 28 can be provided with an electrical receptable such as shown at 39.

In order to connect two of the panels 10 transversely to one another, so as to provide, for example, a corner formed by two intersecting walls, a connecting means in the form of an L-shaped or angle iron connector 40 (shown best in FIGS. 2 and 3) is employed. The connector 40 extends preferably for the full height of the panels and its two sides or flanges 42 are connected together at an angle of substantially 90° when the two walls are to form a right angle corner. It will be appreciated however, that where it is desirable to make a corner which is other than 90°, the angle of intersection of the side flanges 42 substantially equals the supplementary angle of the angle of the corner. Thus, for example, where a corner of 110° is desired, the angle of intersection of the side flanges 42 equals 70°. Each side flange 42 extends into a corresponding one of the channels 26 of the two adjoining panels (compare FIGS. 2 and 3), making a snug, preferably a tight, fit with the tongue 24 and extension 20 of the respective panel and holding the adjacent side edges of the two adjacent panels close to or in contact with one another. As a result a corner is provided by the two panels which exhibits good sound attenuating characteristics.

Figure 4:
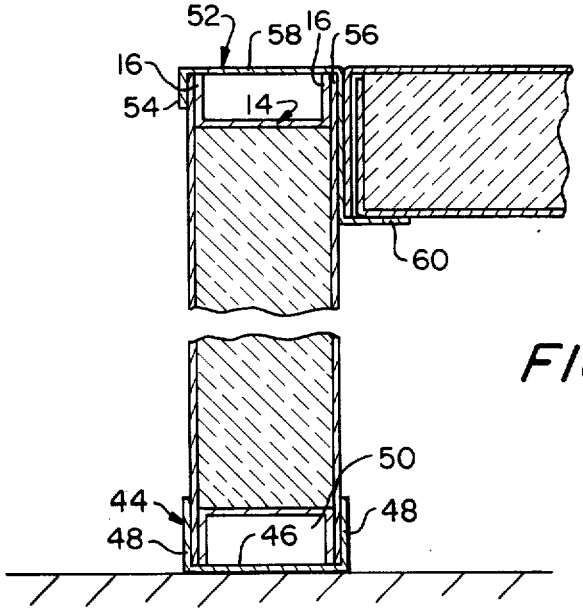
FIG. 4 shows a fragmented sectional view in side elevation of the assembly of the FIG. 1.

Referring to FIGS. 1 and 4, a floor channel member 44 is used to reinforce the lower longitudinal edges of the panels, secure the joined panels to the floor, and also restrain connector members 28 and 34 against separating movement. Floor channel member 44 hs a web or strap portion 46 which is secured directly to the floor (by nails, rivets or other suitable means) and parallel spaced-apart right angle side portions 48 which extend upwardly from connecting portion 46 and defines a U-shaped channel 50 therebetween. The width of the channel 50 is such that the lower longitudinal ends of the plates 12A and 12B make a close, preferably tight, fit with the side portions 48 of the channel while resting on the connecting portion 46. It will be appreciated that since the web portions 32 and 38 of the respective channel members 28 and 34 are flush with the plates 12A and 12B, respectively, the lower end of each connecting channel member 28 and 34 will make a close or tight fit relationship with the side portions 48 of the floor channel member so as to be locked in place. The lower longitudinal edges of the panels are thus not only secured to the floor by channel member 44 but are also structurally reinforced by the latter against any lateral forces applied transversely to the panels.

Similarly, ceiling or roof caps 52 are provided in order to lock together the upper ends of the members 28 and 34 of the double channel connector and also to structurally reinforce the upper margins of each of the panels 10. Each cap 52 includes a pair of side sections 54 and 56 which are connected together by a web or strap 58 to form a U-shaped channel with right angle corners. The width of channel 58 is such that the upper edges of the plates 12A and 12B and channel connectors 28 and 34 fit tightly between the side sections 54 and 56 and are engaged by strap 58. Preferably, the lower edge of the side portion 56 of the cap is provided with a lip 60 to support a ceiling panel 62. The lip 60 extends away from the panel assembly into the room defined by the panel assemblies. Preferably lip 60 extends at a right angle to the side section 56 and parallel to the strap 58, and is preferably spaced from the strap 58 so that when sound absorbing ceiling panel 62 is supported by it, the upper surface of the panel 62 will be disposed flush with the upper edges of the panels 10.

The ceiling panels 62 are preferably identical in structure to the panels 10 and a number of them can be assembled and connected by double channel connectors consisting of channel members 28' and 34' like members 28 and 34 to form a continuous ceiling. The ceiling panels and their double channel connectors are supported at the periphery of the ceiling by the lips 60 of cap members 52, whereby the ceiling panels extend substantially parallel to the floor at right angles to the panels 10. The ceiling panels 62 are disposed so that their perforated sides face down into the room. As shown in FIG. 1, when it is desirable to utilize the double channel connectors of the ceiling as raceways to accommodate, for example, electrical cable 64, an aperture 66 is preferably provided in the upper end of the web portion 32 of member 28 and side section 56 of cap 52. The aperture 66 communicates with a corresponding ceiling double channel connector formed by members 28' and 34' so that the cable 64 extends up the raceway provided by the wall double channel connector through aperture 66, into the raceway provided by the ceiling double channel connector.

The assembly thus described can easily be constructed to provide walls and ceilings having good acoustical insulation properties. For example, the preferred step in constructing walls is to first secure the floor channels 44 to the floor in the desired locations. For each wall the panels 10 are then aligned and oriented so that the tongues 24 of the confronting side edges of adjacent panels confront one another and so that the open sides of the channels 26 of the panels all face in the same direction. The panels 10 are inserted with the channels 50 of floor channel members 44. The side plates 30 of each outer channel connector 28 are inserted into the corresponding channels 26 of two adjacent panels so that the web 32 is flush with the two plates 12A of the two panels and located within the acoustical floor channel 50. Each inner connector 34 is inserted between the two adjacent panels so that the side plates 36 contact the tongues of the two panels in a tight fitting relationship and so that the strap 34 is flush with the plates 12B of the two panels. Each inner channel connector also is located within the acoustical floor channel 50. Where corners are desired to be provided between two panels 10, the panels are positioned transversely to one another with the open edge of the channels 26 of the confronting side edges facing the apex of the corner to be formed. Each side flange 42 of a corner connector 40 is inserted into a corresponding one of the channels 26 and also the acoustical floor channel 50 to provide a tight, structurally supported corner. The top longitudinal edges of the assembled panels are next fitted with the ceiling cap 52 so as to lock together the upper ends of channel connections 28 and 34. As an alternative procedure, the panels 10 may be assembled and intermated end-to-end, and then the lower longitudinal edges of the assembled panels inserted into channel 50 between the side flanges 48 of the floor channel member 44 in a tight fitting relationship.

Finally, the ceiling panels are assembled in a similar manner as the wall panels 10 with double channel connectors consisting of connectors 28 and 34 and disposed over and in contact with the lips 60 to provide a false ceiling. Having the lower exposed surfaces of the ceiling panels lie below the upper edges of the panels 10 insures good sound attenuation in the corners formed by ceiling and walls.

The assembly thus described provides a modular wall and ceiling assembly which has relatively improved acoustical insulation and structural properties (as the double channel connectors provide an acoustically and structurally tight joint), can easily accommodate water and heating pipes, electrical cable and the like through the raceway provided by the inner and outer panel connectors 28 and 34, and utilizes identical panels for both wall and ceiling structures. Further, by dimensioning each of the panels 10 to that of the size of standard door frames and doors, a door frame and door can easily be substituted for one of the panels, thus making it easy to adapt the assembly to present construction demands. Also, the plates 12A and 12B, the stiffeners 14A and 14B, (and also connector channel members 28 and 34) may be made of metal and connected together by spot welding or rivets. Alternatively, they may be made of plastic materials and locked together by a cement or suitable fasteners or ultrasonic welding.

Obviously, certain changes may be made in the above apparatus without departing from the scope of the invention herein involved. Thus, for example, the tongues 24 need not extend the full length of the panels 10 but instead each may be slotted so as to form two or more smaller tongues spaced along the edge of the panel. Similarly, the sides 48 of the floor channels need not be continuous but may be slotted so that only portions of the panels 10 and the channel connectors 28 and 34 are engaged thereby. Also, if no ceiling is required, the caps 52 may be replaced by channel members like floor channel member 44. Still other changes will be obvious to persons skilled in the art. Therefore, it is intended that all matter contained in the above description or shown in the accompanying drawing shall be interpreted in an illustrative and not in a limiting sense. It is to be understood that as used in the appended claims the term "wall assembly" denotes either a wall or ceiling of floor.

What is claimed is:

1. A modular wall assembly comprising, in combination:

at least two panels each including a substantially flat body and a tongue at each of two opposite edges extending substantially parallel to and spaced from said body so as to form a channel therebetween, said channels being open at corresponding ends thereof, along one side of each panel, said panels being aligned and oriented so that one of said opposite edges of one of the panels is in mutually confronting and spaced relationship with one of the opposite edges of another panel;

a first connector member having two parallel spaced-apart side plates and a web connected to and supporting said side plates, each of said side plates extending within a corresponding one of said channels and making a snug fit with the adjacent tongue and flat body; and a second connector member having two parallel spaced-apart side plates and a web connected to and supporting said side plates, the side plates of said second connector extending between and making a snug fit with said tongues.

2. A wall assembly according to claim 1 wherein said first connector member is a U-shaped channel member.

3. A wall assembly according to claim 1 wherein said second connector member is a U-shaped channel member.

4. A wall assembly according to claim 1 wherein said first and second connector members are U-shaped channel members and coact to form a hollow column between said panels.

5. A wall assembly according to claim 1 further including means forming a main channel, and further wherein each of said panels has a bottom longitudinal edge disposed within said main channel.

6. A wall assembly according to claim 1 wherein said panels each have a top longitudinal edge and further including a cap member overlying said top longitudinal edge of at least one of said panels.

7. A wall assembly according to claim 6 wherein said cap member includes a lip for supporting at least one additional panel so that it extends at a right angle to the plane of said at least two panels.

8. A wall assembly according to claim 1 wherein each panel body comprises a pair of spaced wall plates and means extending between and connecting said wall plates so as to maintain said plates in parallel spaced relationship to one another.

9. A wall assembly according to claim 8 wherein said last mentioned means comprises at least one stiffener member having two side flanges with each side flange being secured to a corresponding one of said wall plates.

10. A wall assembly according to claim 9, wherein each panel has one of said tongues at each of two opposite edges of one of said wall plates, and further wherein said stiffener member has two end flanges which extend transversely of its side flanges and are secured to extensions of the other wall plate.

11. A wall assembly according to claim 10, wherein each stiffener has a corner relief between its side and end flanges.

12. A wall assembly according to claim 8, wherein each of said panels further includes sound absorbing material disposed between said wall plates.

13. A wall assembly according to claim 12 wherein at least one of said wall plates has sound transmitting openings therein.

14. A wall assembly in accordance with claim 8, wherein said tongue is integrally formed with one of said plates.

15. A wall assembly in accordance with claim 13, wherein the other of said plates includes at least one side extending portion spaced from said tongue and defining one side of said channel.

16. A wall assembly comprising, in combination:

at least first and second panels each including a substantially flat body and a tongue at at least one edge extending substantially parallel to and spaced from said body so as to form a channel therebetween, said first and second panels being disposed and oriented so that one edge of said first panel is adjacent to and in spaced relationship with one edge of the second panel and the planes of said first and second panels extend transversely to one another at a predetermined angle; and an L-shaped connector member having two side flanges extending transversely to one another, each of said side flanges extending within one of said channels and making a tight fit with the adjacent tongue and flat body of one of said first and second panels.

17. A wall panel assembly in accordance with claim 16 wherein the side flanges of said connector member extend at an angle which is the supplement of said predetermined angle.

18. A modular wall assembly comprising, in combination:

at least two panels each including a substantially flat body, a side plate at one edge of said body, and a tongue at said one edge extending substantially parallel to and spaced from said side plate so as to form a channel therebetween, said panels being aligned and oriented so that said one edges are in mutually confronting and spaced relationship;

a first connector member having two parallel spaced-apart side plates and a web connected to and supporting said side plates, each of said side plates of said first connector being dimensioned so as to extend within a corresponding one of said channels and so as to be easily movable into and out of said channel making a snug fit with the adjacent tongue and side plate of said panel; and a second connector member having two parallel spaced-apart side plates and a web connected to and supporting said side plates, the side plates of said second connector extending between and making a snug fit with said tongues.

19. A modular wall assembly comprising, in combination:

at least two panels each including a substantially flat body and a tongue at one edge extending substantially parallel to and spaced from said body so as to form a channel therebetween, said panels being aligned and oriented so that said one edges are in mutually confronting and spaced relationship;

a first connector member having two parallel spaced-apart side plates and a web connected to and supporting said side plates, each of said side plates extending within a corresponding one of said channels and making a snug fit with the adjacent tongue and flat body; and a second connector member having two parallel spaced-apart side plates and a web connected to and supporting said side plates, the side plates of said second connector extending between and making a snug fit with said tongues;

each of said first and second connectors being independently removable from between said panels by moving each connector in a direction substantially perpendicular to said flat bodies of said panels.

* * * * *